US008106247B2

(12) United States Patent
Ryder

(10) Patent No.: US 8,106,247 B2
(45) **Date of Patent: *Jan. 31, 2012**

(54) JET FUEL COMPOSITIONS AND METHODS OF MAKING AND USING SAME

(75) Inventor: Jason A. Ryder, Oakland, CA (US)

(73) Assignee: Amyris, Inc., Emeryville, CA (US)

( * ) Notice: Subject to any disclaimer, the term of this patent is extended or adjusted under 35 U.S.C. 154(b) by 409 days.

This patent is subject to a terminal disclaimer.

(21) Appl. No.: 12/432,733

(22) Filed: Apr. 29, 2009

(65) Prior Publication Data

US 2009/0272119 A1 Nov. 5, 2009

Related U.S. Application Data

(60) Provisional application No. 61/050,171, filed on May 2, 2008.

(51) Int. Cl.

| | |
|---|---|
| ***C10L 1/16*** | (2006.01) |
| ***C07C 13/00*** | (2006.01) |
| ***C07C 13/615*** | (2006.01) |

(52) U.S. Cl. ..... 585/14; 585/20; 585/21; 123/1 A; 435/166; 44/300

(58) Field of Classification Search ..... 585/14, 585/20, 21; 123/1 A; 435/166; 44/300
See application file for complete search history.

(56) References Cited

U.S. PATENT DOCUMENTS

| | | | | |
|---|---|---|---|---|
| 3,441,497 | A | 4/1969 | Boodman et al. | |
| 7,399,323 | B2 | 7/2008 | Renninger et al. | |
| 7,671,245 | B2 * | 3/2010 | Ryder | 585/21 |
| 2006/0270863 | A1 * | 11/2006 | Reiling et al. | 549/361 |

FOREIGN PATENT DOCUMENTS

| | | | |
|---|---|---|---|
| FR | 859304 | A | 12/1940 |
| WO | WO2007/139924 | A | 12/2007 |

OTHER PUBLICATIONS

Van Aarssen et al., The occurrence of polycyclic sesqui-, tri-, and oligoterpenoids derived from a resinous polymeric cadinene in crude oils from southeast Asia, Geochimica el Cosmochimica Acta, (1992) vol. 56, pp. 1231-1246.
Menchi et al., Catalytic hydrogenation in the identification of constituents of an Italian lignite, Fuel (1995) vol. 74, No. 3, pp. 426-430.
Zhao et al., Constituent analysis of extract from Shenful coalwith carbon disulfide, Applied Chemical Industry (2006) vol. 35, No. 6, pp. 470-473.
English translation of D4, (2006) Zhao.
Machine Translation of B2, Dec. 16, 1940.
Int. Search Report, Sep. 30, 2009.
EP Communication pursuant to Article 94(3) EPC, May 16, 2011.
Martins Adio A et al:"Volatile components from European liverworts Marsupella emarginata, M. aquatica and M. alpina", Phytochemistry, Pergamon Press, GB, vol. 61, No. 1, Sep. 1, 2002, p. 79-91.

* cited by examiner

*Primary Examiner* — Cephia D Toomer
(74) *Attorney, Agent, or Firm* — Jones Day; Kam W. Law

(57) ABSTRACT

Provided herein are, among other things, jet fuel compositions and methods of making and using the same. In some embodiments, the fuel compositions comprise at least a fuel component readily and efficiently produced, at least in part, from a microorganism. In certain embodiments, the fuel compositions provided herein comprise a high concentration of at least a bioengineered fuel component. In further embodiments, the fuel compositions provided herein comprise amorphane.

25 Claims, 2 Drawing Sheets

JET FUEL COMPOSITIONS AND METHODS OF MAKING AND USING SAME

PRIOR RELATED APPLICATIONS

This application claims priority to copending U.S. Provisional Patent Application Ser. No. 61/050,171, filed May 2, 2008, which is incorporated herein by reference in its entirety.

FIELD OF THE INVENTION

Provided herein are, among other things, jet fuel compositions and methods of making and using the same. In some embodiments, the fuel compositions comprise at least a fuel component readily and efficiently produced, at least in part, from a microorganism. In certain embodiments, the fuel compositions provided herein comprise a high concentration of at least a bioengineered fuel component. In further embodiments, the fuel compositions provided herein comprise an amorphane.

BACKGROUND OF THE INVENTION

Biofuel is generally a fuel derived from biomass, i.e., recently living organisms or their metabolic byproducts, such as manure from animals. Biofuel is desirable because it is a renewable energy source, unlike other natural resources such as petroleum, coal and nuclear fuels. A biofuel that is suitable for use as jet fuel has yet to be introduced. Therefore, there is a need for biofuels for jet engines. The present invention provides such biofuels.

SUMMARY OF THE INVENTION

Provided herein are, among other things, fuel compositions comprising a fuel component readily and efficiently produced, at least in part, from a microorganism. In certain embodiments, the fuel compositions comprise an amorphane and methods of making and using the same. In further embodiments, the amorphane is produced from a microorganism.

In one aspect, provided herein are fuel compositions comprising or obtainable from a mixture comprising:

(a) an amorphane having formula (I):

(I)

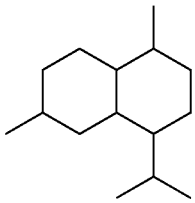

or a stereoisomer thereof, and (b) a fuel additive.

In certain embodiments, the fuel additive disclosed herein is at least one additive selected from the group consisting of an oxygenate, an antioxidant, a thermal stability improver, a stabilizer, a cold flow improver, a combustion improver, an anti-foam, an anti-haze additive, a corrosion inhibitor, a lubricity improver, an icing inhibitor, an injector cleanliness additive, a smoke suppressant, a drag reducing additive, a metal deactivator, a dispersant, a detergent, a de-emulsifier, a dye, a marker, a static dissipater, a biocide, and combinations thereof.

In certain embodiments, the fuel composition disclosed herein comprises or is a petroleum-based fuel. In some embodiments, the petroleum-based fuel in the fuel compositions disclosed herein comprises or is gasoline, kerosene, jet fuel, diesel fuel or a combination thereof. In other embodiments, the petroleum-based fuel in the fuel compositions disclosed herein comprises or is Jet A, Jet A-1, Jet B or a combination thereof. In further embodiments, the fuel compositions disclosed herein meets the ASTM D1655 specification for Jet A, Jet A-1 or Jet B.

In some embodiments, the amount of the amorphane in the fuel compositions disclosed herein is at least about 5 vol. %, at least about 10 vol. %, at least about 15 vol. %, or at least about 20%, based on the total volume of the fuel composition.

In some embodiments, the amorphane in the fuel compositions disclosed herein is:

(II)

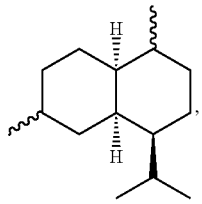

(III)

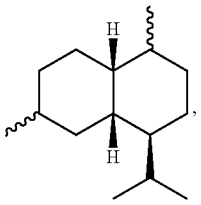

(IV)

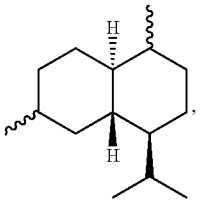

(V)

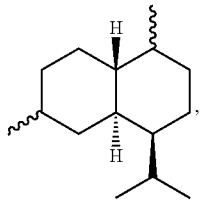

or a combination thereof.

In certain embodiments, the amorphane in the fuel compositions disclosed herein is:

(VI)

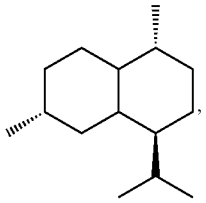

-continued (VII)

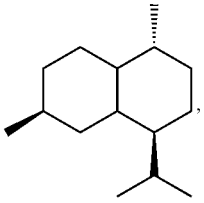

or a combination thereof

In another aspect, provided herein are methods of making a fuel composition from a simple sugar comprising:

(a) contacting a cell capable of making an amorphadiene with the simple sugar under conditions suitable for making the amorphadiene;

(b) converting the amorphadiene to an amorphane; and (c) mixing the amorphane with a petroleum-based fuel to make the fuel composition In certain embodiments, the amorphadiene is converted to the amorphane with hydrogen in the presence of a catalyst. In other embodiments, the catalyst for the methods disclosed herein comprises or is Pd/C. In further embodiments, encompassed herein are fuel compositions obtained by the methods disclosed herein.

In some embodiments, the simple sugar disclosed herein comprises or is glucose, galactose, mannose, fructose, ribose, or a combination thereof In certain embodiments, provided herein are vehicles comprising an internal combustion engine, a fuel tank connected to the internal combustion engine, and the fuel composition disclosed herein in the fuel tank. In other embodiments, the internal combustion engine disclosed herein is a jet engine.

In certain embodiments, provided herein is a method of powering an engine comprising the step of combusting the fuel composition disclosed herein in the engine. In some embodiments, the engine disclosed herein is a jet engine.

DEFINITIONS

Figure 1:
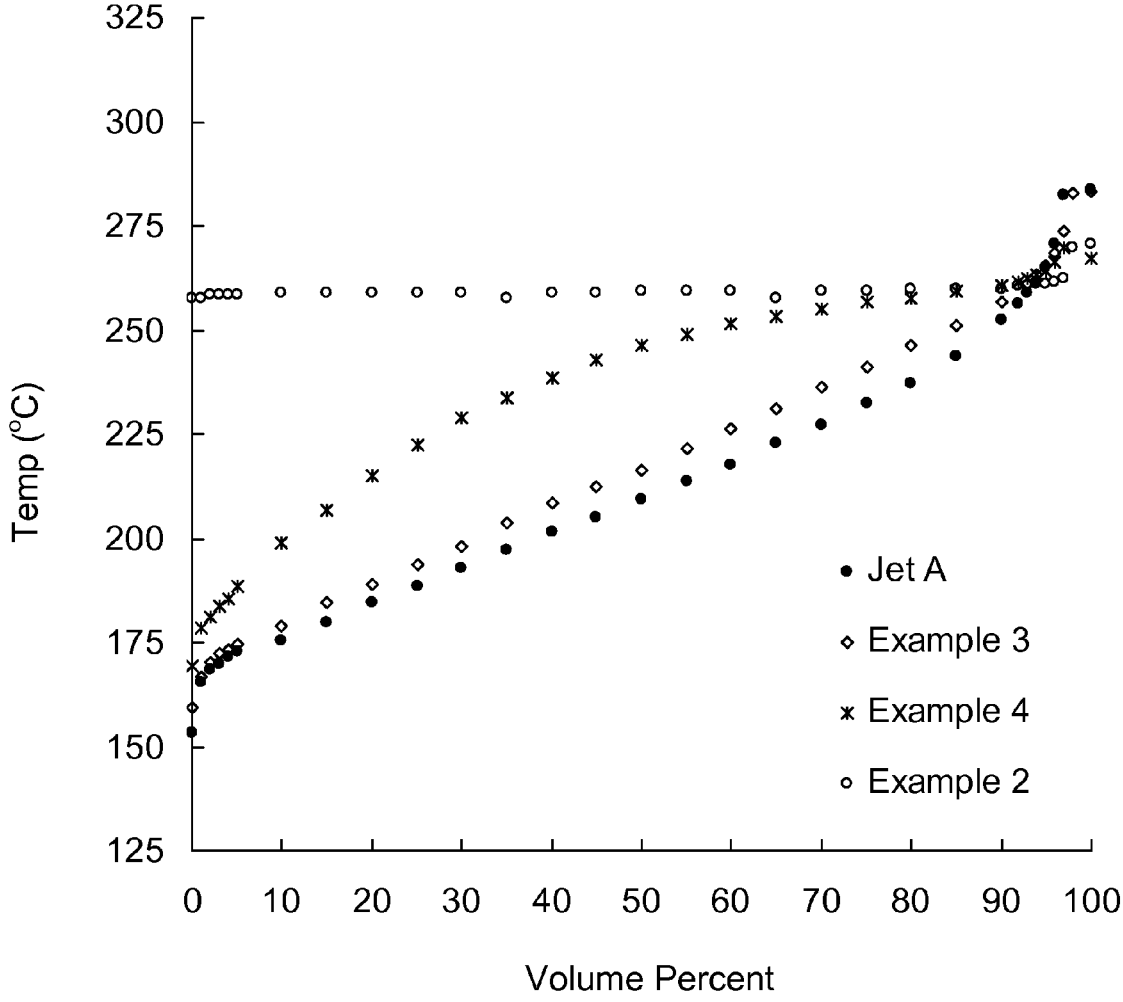
FIG. 1 depicts the distillation curves of a Jet A fuel and Examples 2-4 from ASTM D86 distillation tests in ° C.

The ASTM D 1655 specifications, published by ASTM International, set certain minimum acceptance requirements for Jet A, Jet A-1, and Jet B. The ASTM D 1655 specifications are incorporated herein by reference.

"Amorphane" refers to a compound having formula (I):

(I)

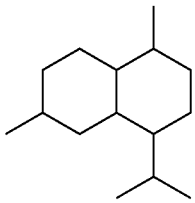

or a stereoisomer thereof. Some non-limiting examples of the stereoisomers of the amorphane include formulae (II)-(VII):

(II)

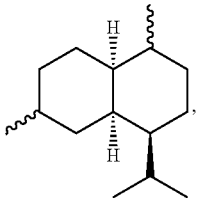

(III)

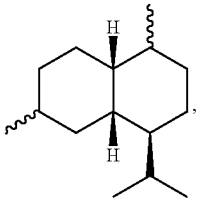

(IV)

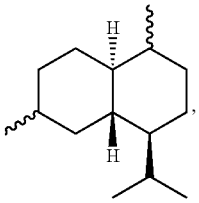

(V)

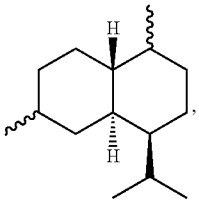

(VI)

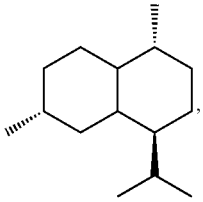

(VII)

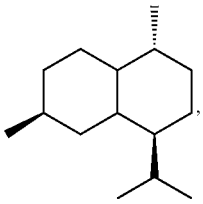

and stereoisomers thereof. In some embodiments, Formula (I) or a stereoisomer thereof include amorphane (i.e., formula II), muurolane (i.e., formula III), cadinane (i.e., formula IV), bulgarane (i.e., formula V) and stereoisomers thereof.

"Bioengineered compound" refers to a compound made by a host cell, including any archae, bacterial, or eukaryotic cells or microorganism.

"Biofuel" refers to any fuel that is derived from a biomass, i.e., recently living organisms or their metabolic byproducts, such as manure from cows. It is a renewable energy source, unlike other natural resources such as petroleum, coal and nuclear fuels.

"Density" refers to a measure of mass per volume at a particular temperature. The generally accepted method for measuring the density of a fuel is ASTM Standard D 4052, which is incorporated herein by reference.

"Doctor Test" is for the detection of mercaptans in petroleum-based fuels such as jet fuel and kerosene. This test may also provide information on hydrogen sulfide and elemental sulfur that may be present in the fuels. The generally accepted method for measuring the freezing point of a fuel is ASTM Standard D 4952, which is incorporated herein by reference.

"Flash point" refers to the lowest temperature at which the vapors above a flammable liquid will ignite in the air on the application of an ignition source. Generally, every flammable liquid has a vapor pressure, which is a function of the temperature of the liquid. As the temperature increases, the vapor pressure of the liquid increases. As the vapor pressure increases, the concentration of the evaporated liquid in the air increases. At the flash point temperature, just enough amount of the liquid has vaporized to bring the vapor-air space over the liquid above the lower flammability limit. For example, the flash point of gasoline is about −43° C. which is why gasoline is so highly flammable. For safety reasons, it is desirable to have much higher flash points for fuel that is contemplated for use in jet engines. The generally accepted methods for measuring the flash point of a fuel are ASTM Standard D 56, ASTM Standard D 93, ASTM Standard D 3828-98, all of which are incorporated herein by reference.

"Freezing point" refers to the temperature at which the last wax crystal melts, when warming a fuel that has been previously been cooled until waxy crystals form. The generally accepted method for measuring the freezing point of a fuel is ASTM Standard D 2386, which is incorporated herein by reference.

"Fuel" refers to one or more hydrocarbons, one or more alcohols, one or more fatty esters or a mixture thereof. Preferably, liquid hydrocarbons are used. Fuel can be used to power internal combustion engines such as reciprocating engines (e.g., gasoline engines and diesel engines), Wankel engines, jet engines, some rocket engines, missile engines and gas turbine engines. In some embodiments, fuel typically comprises a mixture of hydrocarbons such as alkanes, cycloalkanes and aromatic hydrocarbons. In other embodiments, fuel comprises amorphane.

"Fuel additive" refers to chemical components added to fuels to alter the properties of the fuel, e.g., to improve engine performance, fuel handling, fuel stability, or for contaminant control. Types of additives include, but are not limited to, antioxidants, thermal stability improvers, cetane improvers, stabilizers, cold flow improvers, combustion improvers, anti-foams, anti-haze additives, corrosion inhibitors, lubricity improvers, icing inhibitors, injector cleanliness additives, smoke suppressants, drag reducing additives, metal deactivators, dispersants, detergents, demulsifiers, dyes, markers, static dissipaters, biocides and combinations thereof. The term "conventional additives" refers to fuel additives known to skilled artisan, such as those described above, and does not include amorphane.

"Fuel component" refers to any compound or a mixture of compounds that are used to formulate a fuel composition. There are "major fuel components" and "minor fuel components." A major fuel component is present in a fuel composition by at least 50% by volume; and a minor fuel component is present in a fuel composition by less than 50%. Fuel additives are minor fuel components. Amorphane can be a major component or a minor component, or in a mixture with other fuel components.

"Fuel composition" refers to a fuel that comprises at least two fuel components.

"Jet fuel" refers to a fuel suitable for use in a jet engine.

"Kerosene" refers to a specific fractional distillate of petroleum (also known as "crude oil"), generally between about 150° C. and about 275° C. at atmospheric pressure. Crude oils are composed primarily of hydrocarbons of the paraffinic, naphthenic, and aromatic classes.

"Missile fuel" refers to a fuel suitable for use in a missile engine.

"Petroleum-based fuel" refers to a fuel that includes a fractional distillate of petroleum.

"Smoke Point" refers to the point in which a fuel or fuel composition is heated until it breaks down and smokes. The generally accepted method for measuring the smoke point of a fuel is ASTM Standard D 1322, which is incorporated herein by reference.

"Viscosity" refers to a measure of the resistance of a fuel or fuel composition to deform under shear stress. The generally accepted method for measuring the viscosity of a fuel is ASTM Standard D 445, which is incorporated herein by reference.

"Stereoisomer" of a molecule refers to an isomeric form of the molecule that has the same molecular formula and sequence of bonded atoms (constitution) as another stereoisomer of the same molecule, but the stereoisomers differ in the three-dimensional orientations of their atoms in space. In some embodiments, the stereoisomer disclosed herein include a single enantiomer, a single diastereoisomer, a pair of enantiomers, a mixture of diastereoisomers, or a mixture of enantiomers and diastereoisomers. An enantiomeric pair refer to two enantiomers that are related to each other by a reflection operation, i.e., they are mirror images of each other. Diastereoisomers refer to stereoisomers that are not related through a reflection operation, i.e., they are not mirror images of each other.

A "substantially pure" compound refers to a composition that is substantially free of one or more other compounds, i.e., the composition contains greater than 80 vol. %, greater than 90 vol. %, greater than 95 vol. %, greater than 96 vol. %, greater than 97 vol. %, greater than 98 vol. %, greater than 99 vol. %, greater than 99.5 vol. %, greater than 99.6 vol. %, greater than 99.7 vol. %, greater than 99.8 vol. %, or greater than 99.9 vol. % of the compound; or less than 20 vol. %, less than 10 vol. %, less than 5 vol. %, less than 3 vol. %, less than 1 vol. %, less than 0.5 vol. %, less than 0.1 vol. %, or less than 0.01 vol. % of the one or more other compounds, based on the total volume of the composition.

A composition that is "substantially free" of a compound refers to a composition containing less than 20 vol. %, less than 10 vol. %, less than 5 vol. %, less than 4 vol. %, less than 3 vol. %, less than 2 vol. %, less than 1 vol. %, less than 0.5 vol. %, less than 0.1 vol. %, or less than 0.01 vol. % of the compound, based on the total volume of the composition.

A compound that is "stereochemically pure" refers to a composition that comprises one stereoisomer of the compound and is substantially free of other stereoisomers of that compound. For example, a stereomerically pure composition of a compound having one chiral center will be substantially free of the opposite enantiomer of the compound. A stereomerically pure composition of a compound having two chiral centers will be substantially free of other diastereomers of the compound. A typical stereomerically pure compound comprises greater than about 80% by weight of one stereoisomer of the compound and less than about 20% by weight of other stereoisomers of the compound, more preferably greater than about 90% by weight of one stereoisomer of the compound and less than about 10% by weight of the other stereoisomers of the compound, even more preferably greater than about 95% by weight of one stereoisomer of the compound and less than about 5% by weight of the other stereoisomers of the compound, and most preferably greater than about 97% by weight of one stereoisomer of the compound and less than about 3% by weight of the other stereoisomers of the compound.

A compound that is "enantiomerically pure" refers to a stereomerically pure composition of the compound having one chiral center.

"Racemic" or "racemate" refers to about 50% of one enantiomer and about 50% of the corresponding enantiomer relative to all chiral centers in the molecule. The invention encompasses all enantiomerically pure, enantiomerically enriched, diastereomerically pure, diastereomerically enriched, and racemic mixtures of the compounds of the invention.

In addition to the definitions above, certain compounds described herein have one or more double bonds that can exist as either the Z or E isomer. In certain embodiments, compounds described herein are present as individual isomers substantially free of other isomers and alternatively, as mixtures of various isomers, e.g., racemic mixtures of stereoisomers.

In the following description, all numbers disclosed herein are approximate values, regardless whether the word "about" or "approximate" is used in connection therewith. They may vary by 1 percent, 2 percent, 5 percent, or, sometimes, 10 to 20 percent. Whenever a numerical range with a lower limit, $R^L$, and an upper limit, $R^U$, is disclosed, any number falling within the range is specifically disclosed. In particular, the following numbers within the range are specifically disclosed: $R=R^L+k*(R^U-R^L)$, wherein k is a variable ranging from 1 percent to 100 percent with a 1 percent increment, i.e., k is 1 percent, 2 percent, 3 percent, 4 percent, 5 percent, . . . , 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed.

DESCRIPTION OF EMBODIMENTS OF THE INVENTION

In one aspect, the invention provides a fuel composition comprising or obtainable from a mixture comprising:

(a) an amorphane having formula (I):

(I)

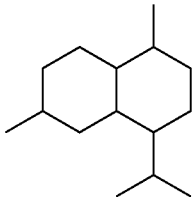

or a stereoisomer thereof, and (b) a fuel, wherein the amount of the amorphane is at least about 2 vol. % and wherein the fuel is either a petroleum-based fuel or a Fischer-Tropsch fuel and the amount of the fuel is at least about 5 vol. %, both amounts based on the total volume of the fuel composition.

In certain embodiments, the amount of the amorphane is from about 2% to about 95%, from about 2% to about 90%, from about 2% to about 80%, from about 2% to about 70%, from about 2% to about 50% or from about 2% to about 45% by weight or volume, based on the total weight or volume of the fuel composition. In other embodiments, the amount of the amorphane is at least about 3%, 5%, 10%, 15%, 20%, 25%, 30%, 35%, 40%, 45%, 50%, 55%, 60%, 65%, 70%, 75%, 80%, 85%, 90%, or 95% by weight or volume, based on the total weight or volume of the fuel composition. In certain embodiments, the amount is in weight % based on the total weight of the fuel composition. In other embodiments, the amount is in volume % based on the total volume of the fuel composition.

In other embodiments, the amorphane is present in an amount of at most about 5%, at most about 10%, at most about 15%, at most about 20%, at most about 25%, at most about 30%, at most about 35%, at most about 40%, at most about 45%, at most about 50%, at most about 60%, at most about 70%, at most about 80%, or at most about 90%, based on the total weight or volume of the fuel composition. In further embodiments, the amorphane is present in an amount from about 2% to about 99%, from about 2.5% to about 95%, from about 5% to about 90%, from about 7.5% to about 85%, from about 10% to about 80%, from about 15% to about 80%, from about 20% to about 75%, or from about 25% to about 75%, based on the total weight or volume of the fuel composition.

In some embodiments, the amorphane is present in an amount between about 2% to about 45%, based on the total weight or volume of the fuel composition. In further embodiments, the amorphane is present in about 5% or at least about 5%, based on the total weight or volume of the fuel composition. In still further embodiments, the amorphane is present in about 10% or at least about 10%, based on the total weight or volume of the fuel composition. In still further embodiments, the amorphane is present in about 15% or at least about 15%, based on the total weight or volume of the fuel composition. In still further embodiments, the amorphane is present in about 20% or at least about 20%, based on the total weight or volume of the fuel composition.

In certain embodiments, the amorphane in the fuel compositions disclosed herein is or comprises:

(II)

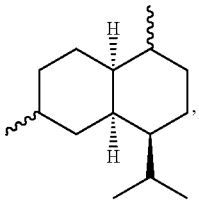

(III)

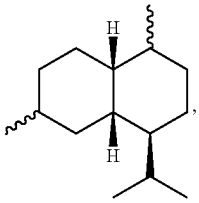

(IV)

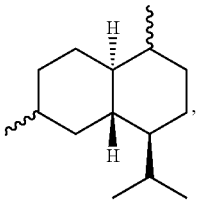

-continued (V)

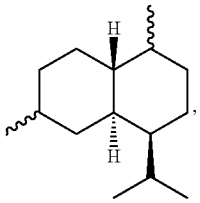

(VI)

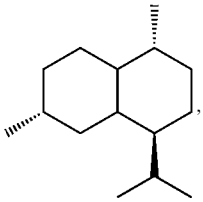

(VII)

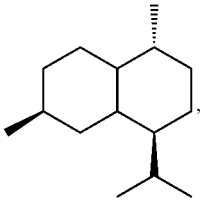

a stereoisomer thereof, or a combination thereof.

In some embodiments, the amorphane in the fuel compositions disclosed herein is or comprises:

(II)

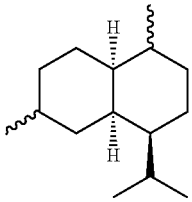

or a stereoisomer thereof.

Some non-limiting examples of stereoisomers of formula (II) include:

(IIA)

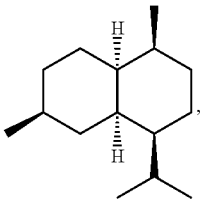

(IIB)

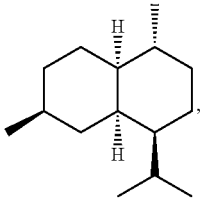

-continued (IIC)

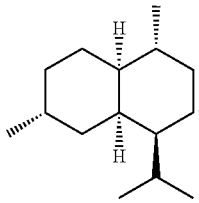

and (IID)

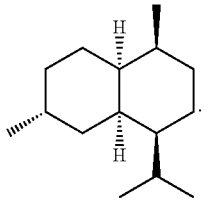

In some embodiments, the amorphane in the fuel compositions disclosed herein is or comprises:

(III)

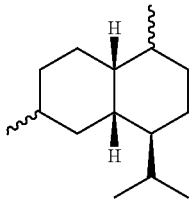

or a stereoisomer thereof.

Some non-limiting examples of stereoisomers of formula (III) include:

(IIIA)

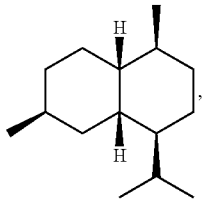

(IIIB)

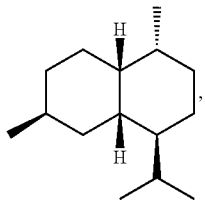

(IIIC)

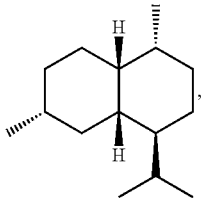

and

-continued (IIID)

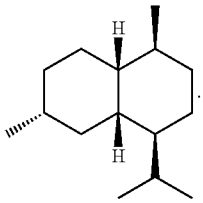

In some embodiments, the amorphane in the fuel compositions disclosed herein is or comprises:

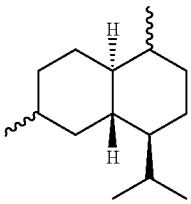

(IV) or a stereoisomer thereof

Some non-limiting examples of stereoisomers of formula (IV) include:

(IVA)

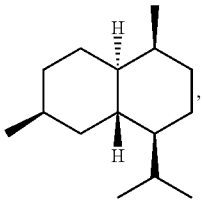

(IVB)

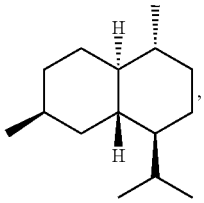

(IVC)

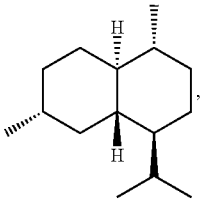

and (IVD)

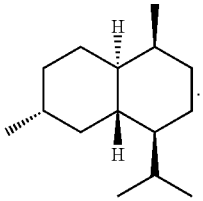

In some embodiments, the amorphane in the fuel compositions disclosed herein is or comprises:

(V)

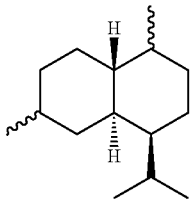

or a stereoisomer thereof.

Some non-limiting examples of stereoisomers of formula (V) include:

(VA)

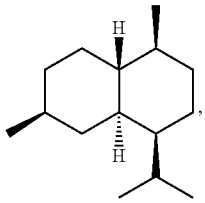

(VB)

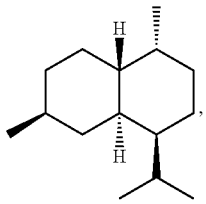

(VC)

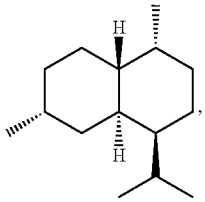

and (VD)

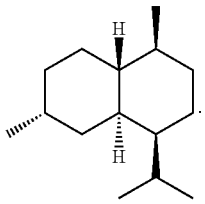

In some embodiments, the amorphane in the fuel compositions disclosed herein is or comprises:

(VI)

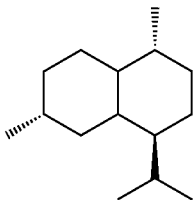

or a stereoisomer thereof.

In other embodiments, the amorphane in the fuel compositions disclosed herein is or comprises:

(VII)

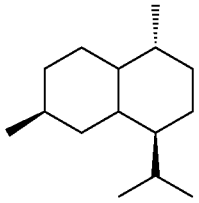

or a stereoisomer thereof.

In further embodiments, the amorphane in the fuel compositions disclosed herein is or comprises a mixture comprising:

(VI)

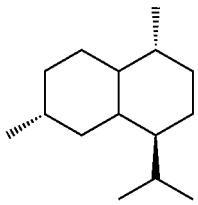

or a stereoisomer thereof, and (VII)

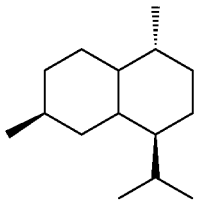

or a stereoisomer thereof.

In some embodiments, the amorphane is derived from amorphadiene. In certain embodiments, the amorphadiene is made by host cells by converting a carbon source into the amorphadiene.

In other embodiments, the carbon source is a sugar such as a monosaccharide (simple sugar), a disaccharide, or one or more combinations thereof. In certain embodiments, the sugar is a simple sugar capable of supporting the growth of one or more of the cells provided herein. The simple sugar can be any simple sugar known to those of skill in the art. Some non-limiting examples of suitable simple sugars or monosaccharides include glucose, galactose, mannose, fructose, ribose, and combinations thereof. Some non-limiting examples of suitable disaccharides include sucrose, lactose, maltose, trehalose, cellobiose and combinations thereof.

In other embodiments, the carbon source is a polysaccharide. Some non-limiting examples of suitable polysaccharides include starch, glycogen, cellulose, chitin and combinations thereof.

In still other embodiments, the carbon source is a non-fermentable carbon source. Some non-limiting examples of suitable non-fermentable carbon source include acetate and glycerol.

In some embodiments, the fuel is a petroleum-based fuel. In other embodiments, the fuel is a Fischer-Tropsch fuel. In some embodiments, the amount of the petroleum-based fuel or the Fischer-Tropsch fuel in the fuel composition disclosed herein may be from about 5% to about 90%, from about 5% to about 85%, from about 5% to about 80%, from about 5% to about 70%, from about 5% to about 60%, or from about 5% to about 50%, based on the total amount of the fuel composition. In certain embodiments, the amount of the petroleum-based fuel or the Fischer-Tropsch fuel is less than about 95%, less than about 90%, less than about 85%, less than about 75%, less than about 70%, less than about 65%, less than about 60%, less than about 55%, less than about 50%, less than about 45%, less than about 40%, less than about 35%, less than about 30%, less than about 25%, less than about 20%, less than about 15%, less than about 10%, based on the total amount of the fuel composition. In other embodiments, the petroleum based fuel or the Fischer-Tropsch fuel is at least about 5%, at least about 10%, at least about 15%, at least about 20%, at least about 30%, at least about 40%, at least about 50%, at least about 60%, at least about 70%, at least about 80% based on the total amount of the fuel composition. In some embodiments, the amount is in wt. % based on the total weight of the fuel composition. In other embodiments, the amount is in vol. % based on the total volume of the fuel composition.

The Fischer-Tropsch fuel or a component thereof can be prepared by the Fischer-Tropsch process. The Fischer-Tropsch process prepares a Fischer-Tropsch fuel or a component thereof from gases containing hydrogen and carbon monoxide using a Fischer-Tropsch catalyst to form hydrocarbons. These hydrocarbons may require further processing in order to be suitable as a Fischer-Tropsch fuel or a component thereof. For example, a Fischer-Tropsch fuel or a component thereof may be dewaxed, hydroisomerized, and/or hydrocracked using processes known to a person of ordinary skill in the art.

In some embodiments, the petroleum-based fuel is kerosene. Conventional kerosene generally is a mixture of hydrocarbons, having a boiling point from about 285° F. to about 610° F. (i.e., from about 140° C. to about 320° C.).

In other embodiments, the petroleum-based fuel is a jet fuel. Any jet fuel known to skilled artisans can be used herein. The American Society for Testing and Materials ("ASTM") and the United Kingdom Ministry of Defense ("MOD") have taken the lead roles in setting and maintaining specification for civilian aviation turbine fuel or jet fuel. The respective specifications issued by these two organizations are very similar but not identical. Many other countries issue their own national specifications for jet fuel but are very nearly or completely identical to either the ASTM or MOD specification. ASTM D 1655 is the Standard Specification for Aviation Turbine Fuels and includes specifications for Jet A, Jet A-1 and Jet B fuels. Defence Standard 91-91 is the MOD specification for Jet A-1.

Jet A-1 is the most common jet fuel and is produced to an internationally standardized set of specifications. In the United States only, a version of Jet A-1 known as Jet A is also used. Another jet fuel that is commonly used in civilian aviation is called Jet B. Jet B is a lighter fuel in the naphtha-kerosene region that is used for its enhanced cold-weather performance. Jet A, Jet A-1 and Jet B are specified in ASTM Specification D 1655.

Alternatively, jet fuels are classified by militaries around the world with a different system of JP numbers. Some are almost identical to their civilian counterparts and differ only by the amounts of a few additives. For example, Jet A-1 is similar to JP-8 and Jet B is similar to JP-4.

Optionally, the fuel compositions disclosed herein may comprise one or more aromatic compounds. In some embodiments, the total amount of aromatic compounds in the fuel compositions is from about 1% to about 50% by weight or volume, based on the total weight or volume of the fuel composition. In other embodiments, the total amount of aromatic compounds in the fuel compositions is from about 15% to about 35% by weight or volume, based on the total weight or volume of the fuel compositions. In further embodiments, the total amount of aromatic compounds in the fuel compositions is from about 15% to about 25% by weight or volume, based on the total weight or volume of the fuel compositions. In other embodiments, the total amount of aromatic compounds in the fuel compositions is from about 5% to about 10% by weight or volume, based on the total weight or volume of the fuel composition. In still further embodiments, the total amount of aromatic compounds in the fuel compositions is less than about 25% by weight or volume, based on the total weight or volume of the fuel compositions.

Optionally, the fuel composition may further comprise a fuel additive known to a person of ordinary skill in the art. In certain embodiments, the fuel additive is from about 0.1% to about 50% by weight or volume, based on the total weight or volume of the fuel composition. The fuel additive can be any fuel additive known to those of skill in the art. In further embodiments, the fuel additive is selected from the group consisting of oxygenates, antioxidants, thermal stability improvers, stabilizers, cold flow improvers, combustion improvers, anti-foams, anti-haze additives, corrosion inhibitors, lubricity improvers, icing inhibitors, injector cleanliness additives, smoke suppressants, drag reducing additives, metal deactivators, dispersants, detergents, de-emulsifiers, dyes, markers, static dissipaters, biocides and combinations thereof.

The amount of a fuel additive in the fuel composition disclosed herein may be from about 0.1% to less than about 50%, from about 0.2% to about 40%, from about 0.3% to about 30%, from about 0.4% to about 20%, from about 0.5% to about 15% or from about 0.5% to about 10%, based on the total amount of the fuel composition. In certain embodiments, the amount of a fuel additive is less than about 50%, less than about 45%, less than about 40%, less than about 35%, less than about 30%, less than about 25%, less than about 20%, less than about 15%, less than about 10%, less than about 5%, less than about 4%, less than about 3%, less than about 2%, less than about 1% or less than about 0.5%, based on the total amount of the fuel composition. In some embodiments, the amount is in wt. % based on the total weight of the fuel composition. In other embodiments, the amount is in vol. % based on the total volume of the fuel composition.

Illustrative examples of fuel additives are described in greater detail below. Lubricity improvers are one example. In certain additives, the concentration of the lubricity improver in the fuel falls in the range from about 1 ppm to about 50,000 ppm, preferably from about 10 ppm to about 20,000 ppm, and more preferably from about 25 ppm to about 10,000 ppm. Some non-limiting examples of lubricity improver include esters of fatty acids.

Stabilizers improve the storage stability of the fuel composition. Some non-limiting examples of stabilizers include tertiary alkyl primary amines. The stabilizer may be present in the fuel composition at a concentration from about 0.001 wt. % to about 2 wt. %, based on the total weight of the fuel composition, and in one embodiment from about 0.01 wt. % to about 1 wt. %.

Combustion improvers increase the mass burning rate of the fuel composition. Some non-limiting examples of combustion improvers include ferrocene(dicyclopentadienyl iron), iron-based combustion improvers (e.g., TURBOTECT™ ER-18 from Turbotect (USA) Inc., Tomball, Tex.), barium-based combustion improvers, cerium-based combustion improvers, and iron and magnesium-based combustion improvers (e.g., TURBOTECT™ 703 from Turbotect (USA) Inc., Tomball, Tex.). The combustion improver may be present in the fuel composition at a concentration from about 0.001 wt. % to about 1 wt. %, based on the total weight of the fuel composition, and in one embodiment from about 0.01 wt. % to about 1 wt. %.

Antioxidants prevent the formation of gum depositions on fuel system components caused by oxidation of fuels in storage and/or inhibit the formation of peroxide compounds in certain fuel compositions can be used herein. The antioxidant may be present in the fuel composition at a concentration from about 0.001 wt. % to about 5 wt. %, based on the total weight of the fuel composition, and in one embodiment from about 0.01 wt. % to about 1 wt. %.

Static dissipaters reduce the effects of static electricity generated by movement of fuel through high flow-rate fuel transfer systems. The static dissipater may be present in the fuel composition at a concentration from about 0.001 wt. % to about 5 wt. %, based on the total weight of the fuel composition, and in one embodiment from about 0.01 wt. % to about 1 wt. %.

Corrosion inhibitors protect ferrous metals in fuel handling systems such as pipelines, and fuel storage tanks, from corrosion. In circumstances where additional lubricity is desired, corrosion inhibitors that also improve the lubricating properties of the composition can be used. The corrosion inhibitor may be present in the fuel composition at a concentration from about 0.001 wt. % to about 5 wt. %, based on the total weight of the fuel composition, and in one embodiment from about 0.01 wt. % to about 1 wt. %.

Fuel system icing inhibitors (also referred to as anti-icing additive) reduce the freezing point of water precipitated from jet fuels due to cooling at high altitudes and prevent the formation of ice crystals which restrict the flow of fuel to the engine. Certain fuel system icing inhibitors can also act as a biocide. The fuel system icing inhibitor may be present in the fuel composition at a concentration from about 0.001 wt. % to about 5 wt. %, based on the total weight of the fuel composition, and in one embodiment from about 0.01 wt. % to about 1 wt. %.

Biocides are used to combat microbial growth in the fuel composition. The biocide may be present in the fuel composition at a concentration from about 0.001 wt. % to about 5 wt. %, based on the total weight of the fuel composition, and in one embodiment from about 0.01 wt. % to about 1 wt. %.

Metal deactivators suppress the catalytic effect of some metals, particularly copper, have on fuel oxidation. The metal deactivator may be present in the fuel composition at a concentration from about 0.001 wt. % to about 5 wt. %, based on the total weight of the fuel composition, and in one embodiment from about 0.01 wt. % to about 1 wt. %.

Thermal stability improvers are use to inhibit deposit formation in the high temperature areas of the aircraft fuel system. The thermal stability improver may be present in the fuel composition at a concentration from about 0.001 wt. % to about 5 wt. %, based on the total weight of the fuel composition, and in one embodiment from about 0.01 wt. % to about 1 wt. %.

In some embodiments, the fuel composition has a flash point greater than about 32° C., greater than about 33° C., greater than about 34° C., greater than about 35° C., greater than about 36° C., greater than about 37° C., greater than about 38° C., greater than about 39° C., greater than about 40° C., greater than about 41° C., greater than about 42° C., greater than about 43° C., or greater than about 44° C. In other embodiments, the fuel composition has a flash point greater than 38° C. In certain embodiments, the flash point of the fuel composition disclosed herein is measured according to ASTM Standard D 56. In other embodiments, the flash point of the fuel composition disclosed herein is measured according to ASTM Standard D 93. In further embodiments, the flash point of the fuel composition disclosed herein is measured according to ASTM Standard D 3828-98. In still further embodiments, the flash point of the fuel composition disclosed herein is measured according to any conventional method known to a skilled artisan for measuring flash point of fuels.

In some embodiments, the fuel composition has a density at 15° C. from about 750 kg/m$^3$ to about 850 kg/m$^3$, from about 750 kg/m$^3$ to about 845 kg/m$^3$, from about 750 kg/m$^3$ to about 840 kg/m$^3$, from about 760 kg/m$^3$ to about 845 kg/m$^3$, from about 770 kg/m$^3$ to about 850 kg/m$^3$, from about 770 kg/m$^3$ to about 845 kg/m$^3$, from about 775 kg/m$^3$ to about 850 kg/m$^3$, or from about 775 kg/m$^3$ to about 845 kg/m$^3$. In other embodiments, the fuel composition has a density at 15° C. from about 780 kg/m$^3$ to about 845 kg/m$^3$. In still other embodiments, the fuel composition has a density at 15° C. from about 775 kg/m$^3$ to about 840 kg/m$^3$. In still other embodiments, the fuel composition has a density at 15° C. from about 750 kg/m$^3$ to about 805 kg/m$^3$. In certain embodiments, the density of the fuel composition disclosed herein is measured according to ASTM Standard D 4052. In further embodiments, the density of the fuel composition disclosed herein is measured according to any conventional method known to a skilled artisan for measuring density of fuels.

In some embodiments, the fuel composition has a freezing point that is lower than −30° C., lower than −40° C., lower than −50° C., lower than −60° C., lower than −70° C., or lower than −80° C. In other embodiments, the fuel composition has a freezing point from about −80° C. to about −30° C., from about −75° C. to about −35° C., from about −70° C. to about −40° C., or from about −65° C. to about −45° C. In certain embodiments, the freezing point of the fuel composition disclosed herein is measured according to ASTM Standard D 2386. In further embodiments, the freezing point of the fuel composition disclosed herein is measured according to any conventional method known to a skilled artisan for measuring freezing point of fuels.

In some embodiments, the fuel composition has a density at 15° C. from about 750 kg/m$^3$ to about 850 kg/m$^3$, and a flash point equal to or greater than 38° C. In certain embodiments, the fuel composition has a density at 15° C. from about 750 kg/m$^3$ to about 850 kg/m$^3$, a flash point equal to or greater than 38° C., and a freezing point lower than −40° C. In certain embodiments, the fuel composition has a density at 15° C. from about 750 kg/m$^3$ to about 840 kg/m$^3$, a flash point equal to or greater than 38° C., and a freezing point lower than −40° C.

In some embodiments, the fuel composition has an initial boiling point that is from about 140° C. to about 170° C. In other embodiments, the fuel composition has a final boiling point that is from about 180° C. to about 300° C. In still other embodiments, the fuel composition has an initial boiling that is from about 140° C. to about 170° C., and a final boiling point that is from about 180° C. to about 300° C. In certain embodiments, the fuel composition meets the distillation specification of ASTM D 86.

In some embodiments, the fuel composition has a Jet Fuel Thermal Oxidation Tester (JFTOT) temperature that is equal to or greater than 245° C. In other embodiments, the fuel composition has a JFTOT temperature that is equal to or greater than 250° C., equal to or greater than 255° C., equal to or greater than 260° C., or equal to or greater than 265° C.

In some embodiments, the fuel composition has a viscosity at −20° C. that is less than 6 mm$^2$/sec, less than 7 mm$^2$/sec, less than 8 mm$^2$/sec, less than 9 mm$^2$/sec, or less than 10 mm$^2$/sec. In certain embodiments, the viscosity of the fuel composition disclosed herein is measured according to ASTM Standard D 445.

In some embodiments, the fuel composition meets the ASTM D 1655 specification for Jet A-1. In other embodiments, the fuel composition meets the ASTM D 1655 specification for Jet A. In still other embodiments, the fuel composition meets the ASTM D 1655 specification for Jet B.

In another aspect, the invention provides a fuel composition comprising:

(a) an amorphane in an amount that is at least about 5% by volume, based on the total volume of the fuel composition; and (b) a petroleum-based fuel in an amount that is at least 45% by volume, based on the total volume of the fuel composition.

In other embodiments, the amorphane is present in an amount that is between about 5% and about 45% by volume, based on the total volume of the fuel composition. In still other embodiments, the amorphane is present in an amount that is between about 5% and about 40% by volume, based on the total volume of the fuel composition. In still other embodiments the amorphane is present in an amount that is between about 5% and about 35% by volume, based on the total volume of the fuel composition.

In certain other embodiments, the fuel composition has a density at 15° C. of between 750 and 840 kg/m$^3$, has a flash point that is equal to or greater than 38° C.; and freezing point that is lower than −40° C. In still other embodiments, the petroleum-based fuel is Jet A and the fuel composition meets the ASTM D 1655 specification for Jet A. In still other embodiments, the petroleum-based fuel is Jet A-1 and the fuel composition meets the ASTM D 1655 specification for Jet A-1. In still other embodiments, the petroleum-based fuel is Jet B and the fuel composition meets the ASTM D 1655 specification for Jet B.

In another aspect, a fuel system is provided comprising a fuel tank containing the fuel composition disclosed herein. Optionally, the fuel system may further comprise an engine cooling system having a recirculating engine coolant, a fuel line connecting the fuel tank with the internal combustion engine, and/or a fuel filter arranged on the fuel line. Some non-limiting examples of internal combustion engines include reciprocating engines (e.g., gasoline engines and diesel engines), Wankel engines, jet engines, some rocket engines, and gas turbine engines.

In some embodiments, the fuel tank is arranged with said cooling system so as to allow heat transfer from the recirculating engine coolant to the fuel composition contained in the fuel tank. In other embodiments, the fuel system further comprises a second fuel tank containing a second fuel for a jet engine and a second fuel line connecting the second fuel tank with the engine. Optionally, the first and second fuel lines can be provided with electromagnetically operated valves that can be opened or closed independently of each other or simultaneously. In further embodiments, the second fuel is a Jet A.

In another aspect, an engine arrangement is provided comprising an internal combustion engine, a fuel tank containing the fuel composition disclosed herein, a fuel line connecting the fuel tank with the internal combustion engine. Optionally, the engine arrangement may further comprise a fuel filter and/or an engine cooling system comprising a recirculating engine coolant. In some embodiments, the internal combustion engine is a diesel engine. In other embodiments, the internal combustion engine is a jet engine.

When using a fuel composition disclosed herein, it is desirable to remove particulate matter originating from the fuel composition before injecting it into the engine. Therefore, it is desirable to select a suitable fuel filter for use in a fuel system disclosed herein. Water in fuels used in an internal combustion engine, even in small amounts, can be very harmful to the engine. Therefore, it is desirable that any water present in fuel composition be removed prior to injection into the engine. In some embodiments, water and particulate matter can be removed by the use of a fuel filter utilizing a turbine centrifuge, in which water and particulate matter are separated from the fuel composition to an extent allowing injection of the filtrated fuel composition into the engine, without risk of damage to the engine. Other types of fuel filters that can remove water and/or particulate matter also may be used.

In another aspect, a vehicle is provided comprising an internal combustion engine, a fuel tank containing the fuel composition disclosed herein, and a fuel line connecting the fuel tank with the internal combustion engine. Optionally, the vehicle may further comprise a fuel filter and/or an engine cooling system comprising a recirculating engine coolant. Some non-limiting examples of vehicles include cars, motorcycles, trains, ships, and aircraft.

Methods for Making Fuel Compositions

In another aspect, provided herein are methods of making a fuel composition comprising the steps of:

(a) contacting amorphadiene with hydrogen in the presence of a catalyst to form an amorphane; and (b) mixing the amorphane with a fuel component to make the fuel composition.

In one embodiment, the amorphadiene has the structure (VIII)

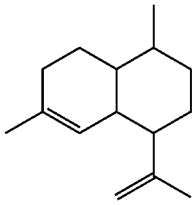

or a stereoisomer thereof.

In another embodiment, the amorphadiene has the following structure:

(IX)

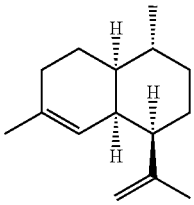

or a stereoisomer thereof.

In another embodiment, the amorphadiene has one of the following structures:

(X)

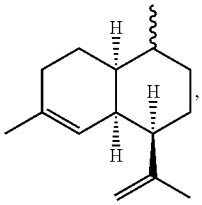

(XI)

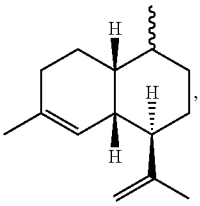

(XII)

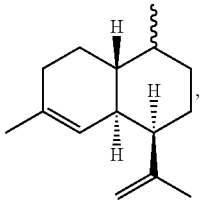

(XIII)

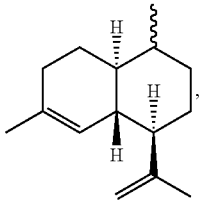

and stereoisomers thereof.

In another aspect, provided herein are methods of making a fuel composition from a simple sugar comprising the steps of:

(a) contacting a cell capable of making amorphadiene with the simple sugar under conditions suitable for making amorphadiene;

(b) converting the amorphadiene to amorphane; and, (c) mixing the amorphane with a fuel component to make said fuel composition.

In some embodiments, the amorphadiene is converted into amorphane by contacting the amorphadiene with hydrogen in the presence of a catalyst.

In another aspect, a facility is provided for manufacture of a fuel, bioengineered fuel component, or bioengineered fuel additive of the invention. In certain embodiments, the facility is capable of biological manufacture of amorphadiene. In certain embodiments, the facility is further capable of preparing a fuel additive or fuel component from the amorphadiene.

The facility can comprise any structure useful for preparing the amorphadiene using a microorganism. In some embodiments, the biological facility comprises one or more of the cells disclosed herein. In some embodiments, the biological facility comprises a cell culture comprising at least amorphadiene in an amount of at least about 1 wt. %, at least about 5 wt. %, at least about 10 wt. %, at least about 20 wt. %, or at least about 30 wt. %, based on the total weight of the cell culture. In further embodiments, the biological facility comprises a fermentor comprising one or more cells described herein.

Any fermentor that can provide cells or bacteria a stable and optimal environment in which they can grow or reproduce can be used herein. In some embodiments, the fermentor comprises a culture comprising one or more of the cells disclosed herein. In other embodiments, the fermentor comprises a cell culture capable of biologically manufacturing farnesyl pyrophosphate (FPP). In certain embodiments, the fermentor comprises a cell culture comprising at least amorphadiene in an amount of at least about 1 wt. %, at least about 5 wt. %, at least about 10 wt. %, at least about 20 wt. %, or at least about 30 wt. %, based on the total weight of the cell culture.

The facility can further comprise any structure capable of manufacturing the fuel component or fuel additive from the amorphadiene. The structure may comprise a hydrogenator for the hydrogenation of the amorphadiene. Any hydrogenator that can be used to reduce C═C double bonds to C—C single bonds under conditions known to skilled artisans may be used herein. The hydrogenator may comprise a hydrogenation catalyst disclosed herein. In some embodiments, the structure further comprises a mixer, a container, and a mixture of the hydrogenation products from the hydrogenation step and a conventional fuel additive in the container.

The simple sugar can be any simple sugar known to those of skill in the art. Some non-limiting examples of suitable simple sugars or monosaccharides include glucose, galactose, mannose, fructose, ribose and combinations thereof. Some non-limiting examples of suitable disaccharides include sucrose, lactose, maltose, trehalose, cellobiose and combinations thereof. In certain embodiments, the bioengineered fuel component can be obtained from a polysaccharide. Some non-limiting examples of suitable polysaccharides include starch, glycogen, cellulose, chitin and combinations thereof.

The monosaccharides, disaccharides and polysaccharides suitable for making the bioengineered tetramethylcyclohexane can be found in a wide variety of crops or sources. Some non-limiting examples of suitable crops or sources include sugar cane, bagasse, miscanthus, sugar beet, sorghum, grain sorghum, switchgrass, barley, hemp, kenaf, potatoes, sweet potatoes, cassava, sunflower, fruit, molasses, whey or skim milk, corn, stover, grain, wheat, wood, paper, straw, cotton, many types of cellulose waste, and other biomass. In certain embodiments, the suitable crops or sources include sugar cane, sugar beet and corn.

Methods for Making Amorphadiene

The compounds of the present invention can be made using any method known in the art including biologically, total chemical synthesis (without the use of biologically derived materials), and a hybrid method where both biologically and chemical means are used. In certain embodiments, amorphadiene is made by host cells by the conversion of simple sugar to the desired product.

When amorphadiene is made biologically, it can be isolated from *Artemisa annua* (which is also know as Sweet Wormwood, Sweet Annie, Sweet Safewort or Annual Wormwood). Alternatively, host cells that are modified to produce amorphadiene can be used. Methods for making amorphadiene using modified host cells have been described by U.S. Pat. Nos. 7,172,886 and 7,192,751 and by PCT Publications WO 2007/140339 and WO 2007/139924.

Chemical Conversion

In certain embodiments, the amorphane in the fuel compositions provided herein are prepared by hydrogenating amorphadiene.

In some embodiments, hydrogenation occurs by reacting the amorphadiene with hydrogen in the presence of a catalyst such as Pd, Pd/C, Pt, $PtO_2$, $Ru(PPh_3)_2Cl_2$, Raney nickel and combinations thereof. Alternatively, any reducing agent that can reduce a C═C bond to a C—C bond can be used. An illustrative example of such a reducing agent is hydrazine in the presence of a catalyst, such as 5-ethyl-3-methyllumiflavinium perchlorate, under an oxygen atmosphere. A reduction reaction with hydrazine is disclosed in Imada et al., *J. Am. Chem. Soc.,* 127, 14544-14545 (2005), which is incorporated herein by reference.

The catalyst for the hydrogenation reaction of amorphadiene can be present in any amount for the reaction to proceed. In some embodiments, the amount of the hydrogenation catalyst is from about 1 g to about 100 g per liter of reactant, from about 2 g to about 75 g per liter of reactant, from about 3 g to about 50 g per liter of reactant, from about 4 g to about 40 g per liter of reactant, from about 5 g to about 25 g per liter of reactant, or from about 5 g to about 10 g per liter of reactant.

In some embodiments, the catalyst is a Pd catalyst. In other embodiments, the catalyst is 5% Pd/C. In still other embodiments, the catalyst is 10% Pd/C. In certain of these embodiments, the catalyst loading is between about 1 g and about 10 g per liter of reactant. In other embodiments, the catalyst loading is between about 5 g and about 5 g per liter of reactant.

In some embodiments, the hydrogenation reaction proceeds at room temperature. However, because the hydrogenation reaction is exothermic, the temperature of the reaction mixture can increase as the reaction proceeds. The reaction temperature can be from about 10° C. to about 75° C., from about 15° C. to about 60° C., from about 20° C. to about 50° C., or from about 20° C. to about 40° C., inclusive.

The pressure of the hydrogen for the hydrogenation reaction can be any pressure that can cause the reaction to proceed. In some embodiments, the pressure of the hydrogen is from about 10 psi to about 1000 psi, from about 50 psi to about 800 psi, from about 400 psi to about 600 psi, or from about 450 psi to about 550 psi. In other embodiments, the pressure of hydrogen is less than 100 psi.

Business Methods

One aspect of the present invention relates to a business method comprising: (a) obtaining a biofuel comprising amorphane derived from amorphadiene by performing a fermentation reaction of a sugar with a recombinant host cell, wherein the recombinant host cell produces the amorphadiene; and (b) marketing and/or selling said biofuel.

In other embodiments, the invention provides a method for marketing or distributing the biofuel disclosed herein to marketers, purveyors, and/or users of a fuel, which method comprises advertising and/or offering for sale the biofuel disclosed herein. In further embodiments, the biofuel disclosed herein may have improved physical or marketing characteristics relative to the natural fuel or ethanol-containing biofuel counterpart.

In certain embodiments, the invention provides a method for partnering or collaborating with or licensing an established petroleum oil refiner to blend the biofuel disclosed herein into petroleum-based fuels such as a gasoline, jet fuel, kerosene, diesel fuel or a combination thereof. In another embodiment, the invention provides a method for partnering or collaborating with or licensing an established petroleum oil refiner to process (for example, hydrogenate, hydrocrack, crack, further purify) the biofuels disclosed herein, thereby modifying them in such a way as to confer properties beneficial to the biofuels. The established petroleum oil refiner can use the biofuel disclosed herein as a feedstock for further chemical modification, the end product of which could be used as a fuel or a blending component of a fuel composition.

In further embodiments, the invention provides a method for partnering or collaborating with or licensing a producer of sugar from a renewable resource (for example, corn, sugar cane, bagass, or lignocellulosic material) to utilize such renewable sugar sources for the production of the biofuels disclosed herein. In some embodiments, corn and sugar cane, the traditional sources of sugar, can be used. In other embodiments, inexpensive lignocellulosic material (agricultural waste, corn stover, or biomass crops such as switchgrass and pampas grass) can be used as a source of sugar. Sugar derived from such inexpensive sources can be fed into the production of the biofuel disclosed herein, in accordance with the methods of the present invention.

In certain embodiments, the invention provides a method for partnering or collaborating with or licensing a chemical producer that produces and/or uses sugar from a renewable resource (for example, corn, sugar cane, bagass, or lignocellulosic material) to utilize sugar obtained from a renewable resource for the production of the biofuel disclosed herein.

EXAMPLES

The following examples are intended for illustrative purposes only and do not limit in any way the scope of the present invention.

The practice of the present invention can employ, unless otherwise indicated, conventional techniques of the biosynthetic industry and the like, which are within the skill of the art. To the extent such techniques are not described fully herein, one can find ample reference to them in the scientific literature.

In the following examples, efforts have been made to ensure accuracy with respect to numbers used (for example, amounts, temperature, and so on), but variation and deviation can be accommodated, and in the event a clerical error in the numbers reported herein exists, one of ordinary skill in the arts to which this invention pertains can deduce the correct amount in view of the remaining disclosure herein. Unless indicated otherwise, temperature is reported in degrees Celsius, and pressure is at or near atmospheric pressure at sea level. All reagents, unless otherwise indicated, were obtained commercially. The following examples are intended for illustrative purposes only and do not limit in any way the scope of the present invention.

Example 1

Amorphadiene (180 mL) was distilled using a short path vacuum distillation apparatus with four flasks on a fraction collector. Amorphadiene was placed in a 500 mL round bottom flask with a magnetic stir bar, evacuated to 1.2 mmHg, and heated to 103° C. The first fraction contained two drops which distilled at 83° C. The second fraction contained approximately 145 mL which distilled at 86° C. The third fraction required heating the pot to 118° C. and approximately 5 mL distilled at 90° C. Heating was ceased and a couple of drops were collected into the fourth fraction while cooling. Analysis of the four colorless fractions by GC/MS as well as the bottoms (viscous yellow) showed that the all fractions as well as the bottoms contained amorphadiene, with the first fraction being the purist.

Example 2

Approximately 150 mL of the distilled amorphadiene was split into three batches of approximately 50 mL for hydrogenation in 75 mL vessels. To each vessel, 50 mL of amorphadiene, a magnetic stir bar and 100 mg Pd/C (Alfa Aesar) were added. The reactors were stirred at 300 rpm and evacuated for 10 minutes. Subsequently, stirring was slowly increased to 1200 rpm for the remainder of the reaction. The reactors were then charged with 200 psig of hydrogen and heating to 100° C. began, continuing overnight.

Analysis of the three reactions by GC/MS the following morning showed no starting material and several peaks with molecular ions of 208, but also indicated 8% of a peak with a molecular ion of 206, indicating incomplete conversion. The reactions were re-started following the same procedure described above, with the exception that the temperature was increased to 125° C. Analysis of the reactors by GC/MS the next morning still showed incomplete conversion, although the peak with a molecular ion of 206 had decreased to ~4%. To increase the reaction rate, an additional 100 mg 5% Pd/C was added to each reactor and the reactions were re-started as described above with heating to 125° C. Analysis of the reactors by GC/MS the following morning showed an insignificant amount of the peak with a molecular ion of 206, and five resolved peaks with molecular ions of 208, indicating complete conversion. The three reactions were then combined and filtered over a small plug of silica gel and glass frit. A total of 126.9 g (approximately 150 mL) of Example 2, a colorless liquid, was collected.

Example 3

Example 3 was obtained by blending 20 vol. % of Example 2 with 80 vol. % of a Jet A fuel. The Jet A fuel was obtained from the Hayward Executive Airport (Chevron) in Hayward, Calif.

Example 4

Example 4 was obtained by blending 50 vol. % of Example 2 with 50 vol. % of a Jet A fuel. The Jet A fuel was obtained from the Hayward Executive Airport (Chevron) in Hayward, Calif.

Example 5

Example 2 was tested according to ASTM D 1655 specifications. The results of these tests are shown in Table 1 below.

TABLE 1

| Property | ASTM Test Method | | Jet A ASTM D1655 Spec. | Jet A | Ex. 3 | Ex. 4 | Ex. 2 |
|---|---|---|---|---|---|---|---|
| COMPOSITION | | | | | | | |
| Appearance | D4176-2 | / | C & B | C & B | C & B | C & B | C & B |
| Acidity (total mg KOH/g) | D3242 | max. | 0.10 | 0.005 | 0.005 | / | / |
| Aromatics (vol. %) | D5186 | max. | 25 | 25.8 | 23.2 | 13.6 | 2.1 |

TABLE 1-continued

| Property | ASTM Test Method | Jet A ASTM D1655 Spec. | | Jet A | Ex. 3 | Ex. 4 | Ex. 2 |
|---|---|---|---|---|---|---|---|
| Sulfur (total mass %) | D4294, D5453 | max. | 0.30 | 0.0685 | 0.0568 | 0.0313 | <0.0001 |
| Sulfur, mercaptan (mass %) | D3227 | max. | 0.003 | 0.0019 | 0.0008 | / | / |
| VOLATILITY | | | | | | | |
| 1. Physical Distillation | | | | | | | |
| Distillation temp. | | | | | | | |
| Initial boiling point, temp. (° C.) | D86 | / | / | 153 | 159 | 169 | 258 |
| 10% recovered, temp. (° C.) | D86 | max. | 205 | 176 | 179 | 199 | 259 |
| 50% recovered, temp. (° C.) | D86 | / | report | 209 | 216 | 246 | 259 |
| 90% recovered, temp. (° C.) | D86 | / | report | 252 | 257 | 261 | 260 |
| Final boiling point, temp. (° C.) | D86 | max. | 300 | 284 | 283 | 267 | 271 |
| Distillation recovery (vol. %) | D86 | / | / | 97.6 | 98.6 | 98.4 | 98.7 |
| Distillation residue (vol. %) | D86 | max. | 1.5 | 1.4 | 1.2 | 0.9 | 1.3 |
| Distillation loss (vol. %) | D86 | max. | 1.5 | 1.0 | 0.2 | 0.7 | 0.0 |
| Flash point (° C.) | D56, D93A | min. | 38 | 43 | 49 | 60 | 113 |
| Density at 15° C. (kg/m$^3$) | D4052 | range | 775-840 | 811.0 | 818.0 | 846.0 | 880.0 |
| FLUIDITY | | | | | | | |
| Freezing point (° C.) | D2386 | max. | −40 | −47 | −48 | −53 | <−52 |
| Viscosity at −20° C. (mm$^2$/s) | D445 | max. | 8.0 | 5.162 | 5.582 | 10.75 | 55.59 |
| COMBUSTION | | | | | | | |
| Net heat of combustion (MJ/kg) | D3338 | min. | 42.8 | 43.42 | 43.10 | 42.97 | 42.79 |
| | D240, D4809 | / | / | 45.19 | 45.75 | 45.43 | 45.24 |
| Smoke Point (mm) | D1322 | min. | 18 | 21 | 20 | 23 | / |
| Naphthalenes (vol. %) | D1840 | max. | 3 | 2.46 | 1.94 | 1.04 | 0.005 |
| CORROSION | | | | | | | |
| Copper strip, 2 h at 100° C. | D130 | / | No. 1 | 1A | 1A | / | / |
| THERMAL STABILITY | | | | | | | |
| JFTOT | | | | | | | |
| Temperature (° C.) | D3241 | / | / | 260 | / | / | / |
| Tube deposits less than | D3241 | / | <3 | <1 | / | / | / |
| Filter pressure drop/150 min. (mm Hg/min) | D3241 | max. | 25 | <1 | / | / | / |
| Spent fuel (mL) | D3241 | / | / | 495 | / | / | / |
| σ ADDITIVES | | | | | | | |
| Electrical conductivity (σ) (pS/m) | D2624 | / | / | 4 | 4 | / | / |
| CONTAMINANTS | | | | | | | |
| Existent gum (mg/100 mL) | D381 | max. | 7 | 1 | 2 | / | / |
| Water reaction: | | | | | | | |
| Interface rating (Interface/Separation) | D1094 | max. | 1b | 1b/2 | 1b/2 | / | / |
| Change in volume (mL) | D1094 | / | / | 0 | 0 | / | / |
| Microseparometer (MSEP-A) | | | | | | | |
| Without σ additive (rating) | D3948 | min. | 85 | 99 | 94 | / | / |
| With σ additive (rating) | / | min. | 70 | / | / | / | / |

Example 6

Figure 2:
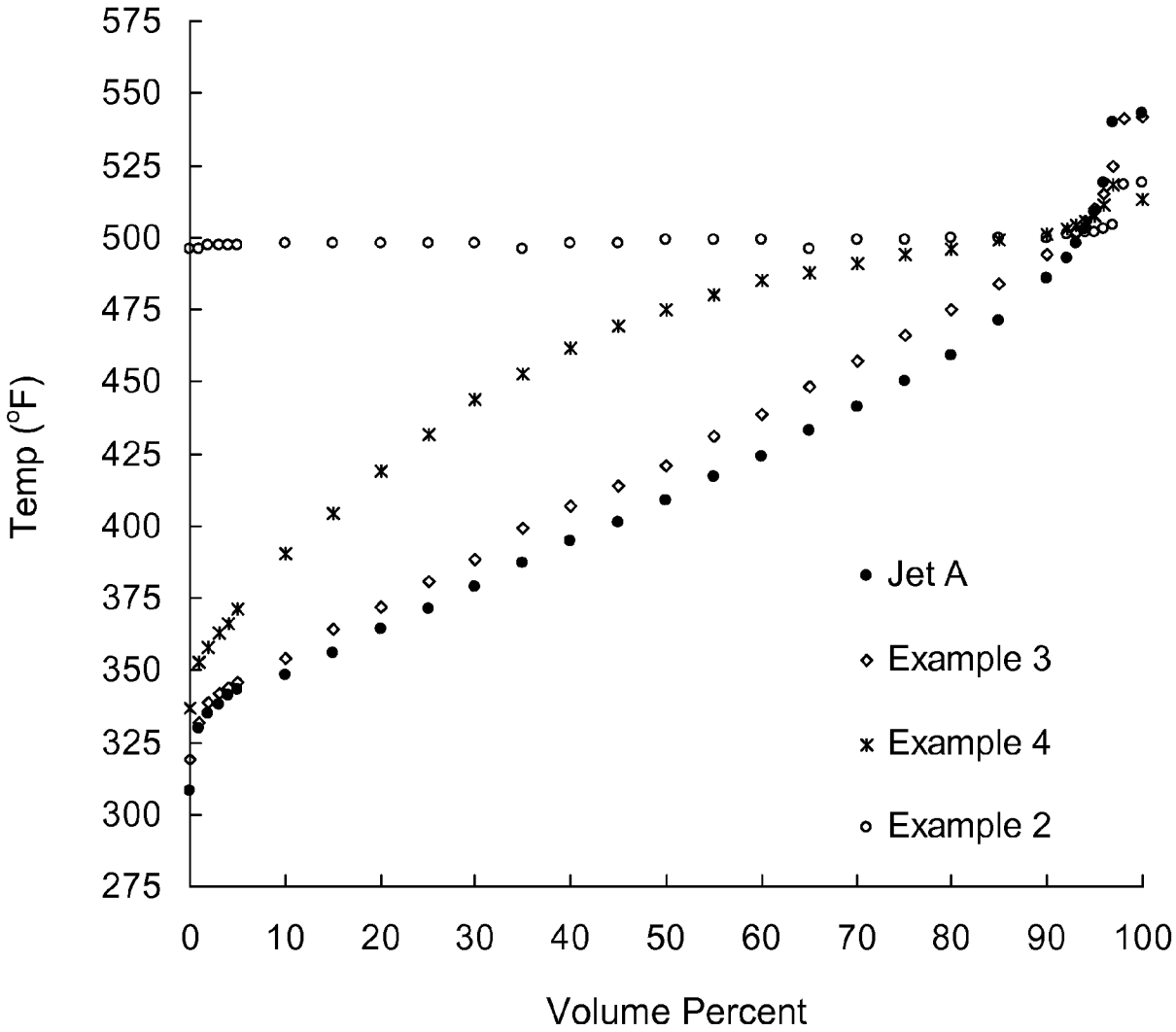
FIG. 2 depicts the distillation curves of a Jet A fuel and Examples 2-4 from ASTM D86 distillation tests in ° F.

FIGS. 1 and 2 are the distillation profiles of the Jet A fuel and Examples 2-4 from the results of ASTM D86 testing in ° C. and ° F. respectively. While the invention has been described with respect to a limited number of embodiments, the specific features of one embodiment should not be attributed to other embodiments of the invention. No single embodiment is representative of all aspects of the claimed subject matter. In some embodiments, the compositions or methods may include numerous compounds or steps not mentioned herein. In other embodiments, the compositions or methods do not include, or are substantially free of, any compounds or steps not enumerated herein. Variations and modifications from the described embodiments exist. It should be noted that the application of the jet fuel compositions disclosed herein is not limited to jet engines; they can be used in any equipment which requires a jet fuel. Although there are specifications for most jet fuels, not all jet fuel compositions disclosed herein need to meet all requirements in the specifications. It is noted that the methods for making and using the jet fuel compositions disclosed herein are described with reference to a number of steps. These steps can be practiced in any sequence. One or more steps may be omitted or combined but still achieve substantially the same results. The appended claims intend to cover all such variations and modifications as falling within the scope of the invention.

All publications and patent applications mentioned in this specification are herein incorporated by reference to the same extent as if each individual publication or patent application was specifically and individually indicated to be incorporated by reference. Although the foregoing invention has been described in some detail by way of illustration and example for purposes of clarity of understanding, it will be readily apparent to those of ordinary skill in the art in light of the teachings of this invention that certain changes and modifications may be made thereto without departing from the spirit or scope of the appended claims.

What is claimed is:

1. A fuel composition comprising or obtainable from a mixture comprising:

(a) an amorphane having formula (I):

(I)

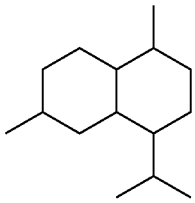

or a stereoisomer thereof, and (b) a fuel additive.

2. The fuel composition of claim 1, wherein the fuel additive is at least one additive selected from the group consisting of an oxygenate, an antioxidant, a thermal stability improver, a stabilizer, a cold flow improver, a combustion improver, an anti-foam, an anti-haze additive, a corrosion inhibitor, a lubricity improver, an icing inhibitor, an injector cleanliness additive, a smoke suppressant, a drag reducing additive, a metal deactivator, a dispersant, a detergent, a de-emulsifier, a dye, a marker, a static dissipater, a biocide, and combinations thereof.

3. The fuel composition of claim 1 further comprising a petroleum-based fuel.

4. The fuel composition of claim 3, wherein the petroleum-based fuel is gasoline, kerosene, jet fuel or diesel fuel.

5. The fuel composition of claim 3, wherein the petroleum-based fuel is Jet A, Jet A-1 or Jet B.

6. The fuel composition of claim 1, wherein the fuel composition meets the ASTM D 1655 specification for Jet A, Jet A-1 or Jet B.

7. The fuel composition of claim 3, wherein the amount of the amorphane is at least about 5 vol. %, based on the total volume of the fuel composition.

8. The fuel composition of claim 3, wherein the amount of the amorphane is at least about 10 vol. %, based on the total volume of the fuel composition.

9. The fuel compositions of claim 3, wherein the amount of the amorphane is at least about 15 vol. %, based on the total volume of the fuel composition.

10. The fuel composition of claim 3, wherein the amount of the amorphane is at least about 20 vol. %, based on the total volume of the fuel composition.

11. The fuel composition of claim 1, wherein the amorphane is (II)

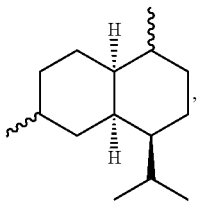

-continued (III)

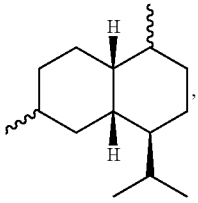

(IV)

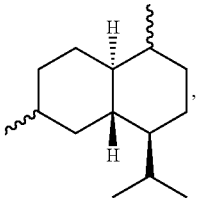

(V)

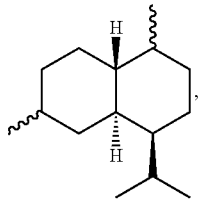

or a combination thereof.

12. The fuel composition of claim 1, wherein the amorphane is (VI)

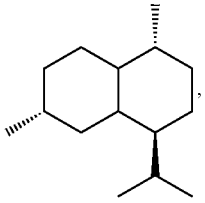

or (VII)

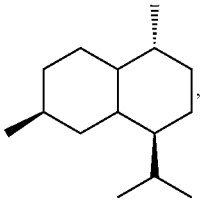

or a combination thereof.

13. A method of making a fuel composition from a simple sugar comprising:

(a) contacting a cell capable of making an amorphadiene with the simple sugar under conditions suitable for making the amorphadiene;

(b) converting the amorphadiene to an amorphane; and (c) mixing the amorphane with a petroleum-based fuel to make the fuel composition.

14. The method of claim 13, wherein the amorphadiene is converted to the amorphane with hydrogen in the presence of a catalyst.

15. The method of claim 14, wherein the catalyst is Pd/C.

16. The method of claim 13 wherein the simple sugar is glucose, galactose, mannose, fructose, ribose, or a combination thereof.

17. A vehicle comprising an internal combustion engine, a fuel tank connected to the internal combustion engine, and the fuel composition of claim 1 in the fuel tank.

18. The vehicle of claim 17 wherein the internal combustion engine is a jet engine.

19. A method of powering an engine comprising the step of combusting the fuel composition of claim 1 in the engine.

20. The method of claim 19, wherein the engine is a jet engine.

21. A fuel composition made by the method of claim 13.

22. A vehicle comprising an internal combustion engine, a fuel tank connected to the internal combustion engine, and the fuel composition of claim 21 in the fuel tank.

23. The method of claim 22, wherein the engine is a jet engine.

24. A method of powering an engine comprising the step of combusting the fuel composition of claim 21 in the engine.

25. The method of claim 24, wherein the engine is a jet engine.

* * * * *